United States Patent [19]

Fong et al.

[11] Patent Number: 5,026,295

[45] Date of Patent: Jun. 25, 1991

[54] COVER FOR AN ELECTRICAL CONNECTOR

[75] Inventors: Jennifer L. C. Fong; Alan B. Berg, both of Singapore, Singapore

[73] Assignee: Molex Incorporated, Lisle, Ill.

[21] Appl. No.: 560,911

[22] Filed: Jul. 31, 1990

[51] Int. Cl.[5] ..... H01R 13/44

[52] U.S. Cl. ..... 439/135; 439/148; 439/149; 439/367; 439/910

[58] Field of Search ..... 439/135, 148–150, 439/367, 892, 893, 521, 51

[56] References Cited

U.S. PATENT DOCUMENTS

| | | | |
|---|---|---|---|
| 3,836,826 | 9/1974 | Hotchkiss et al. | 439/910 |
| 4,197;945 | 4/1980 | Sherwood | 439/149 |
| 4,396,245 | 8/1983 | Lane | 439/148 |
| 4,795,354 | 1/1989 | Owen | 439/135 |
| 4,872,848 | 10/1989 | Mouissie | 439/135 |

*Primary Examiner*—Paula A. Bradley

*Attorney, Agent, or Firm*—Louis A. Hecht; Stephen Z. Weiss; A. A. Tirva

[57] ABSTRACT

A cover is provided for closing a cavity and a polarizing slot of an electrical connector to protect interior terminals during a soldering process with the electrical connector mounted on a printed circuit board. The connector is in the form of a header having side walls and a bottom wall defining the cavity. A polarizing slot is formed in one of the side walls. The terminals are disposed in the cavity, with solder tails projecting through the bottom wall for soldering to circuit traces on the printed circuit board. The cover includes a lid press-fit onto the header to close the cavity, and a projection depends from the lid in position for closing the polarizing slot in the one side wall of the header.

14 Claims, 2 Drawing Sheets

COVER FOR AN ELECTRICAL CONNECTOR

FIELD OF THE INVENTION

This invention generally relates to the art of electrical connectors and, particularly, to a cover for closing an open cavity in an electrical connector to protect interior terminals during processing, such as during wave soldering processes.

BACKGROUND OF THE INVENTION

A wide variety of electrical connectors are used for mounting on printed circuit boards to connect terminals on the connectors to circuit traces on the boards. One type of electrical connector, commonly called a header, includes an elongate, rectangular housing having side walls defining an upwardly opening cavity. Terminal pins are disposed in the cavity, with solder tails projecting through a bottom wall and through holes in the printed circuit board for soldering to circuit traces on the printed circuit board.

Often, connectors of the character described have a polarizing slot in a side wall of the housing to insure proper relative orientation of the terminal pins with contacts of a complementary mating connector. In other words, the terminal pins within the housing cavity are exposed through the polarizing slot in the housing side wall.

Such polarizing slots cause problems during soldering processes, particularly when the connector is located or mounted on the printed circuit board at a location near the edge of the board. During a wave soldering process the terminals within the housing cavity are susceptible to contact with the solder material which could enter through the polarizing slot.

Heretofore, the predominant solution to the aforesaid problem of contaminating the interior terminal pins with solder material has been to close the housing cavity with a cover which is removed after soldering, and to keep the polarizing slot closed with a continuation of the housing side wall which is scored along lines which define the polarizing slot. After soldering, a portion of the side wall is punched out, along the scoring lines, to leave the open polarizing slot for its intended purpose. However, such procedures not only require an additional assembly step during fabrication of the printed circuit board assembly, but removing of a portion of the side wall defining the polarizing slot, after soldering, creates forces which can damage the solder connections and/or damage portions of the connector housing or the terminals themselves.

This invention is directed to solving these problems by closing the polarizing slot, during the soldering process, by the same cover that closes the cavity of the connector housing.

SUMMARY OF THE INVENTION

An object, therefore, of the invention is to provide a new and improved cover for temporarily closing a cavity of a polarized electrical connector to protect the terminals therein during a soldering process or the like.

In the exemplary embodiment of the invention, the cover is designed for use with an electrical connector in the form of a header for mounting on a printed circuit board. The header has a cavity defined by side walls and a bottom wall. Terminal pins are disposed in the cavity, with solder tails projecting through the bottom wall and through holes in the printed circuit board for soldering to circuit traces on the printed circuit board. At least one polarizing slot is provided in the side walls of the header.

The invention contemplates a cover for closing the header cavity to protect the terminals during a soldering process. The cover includes a lid and complementary interengaging means between the lid and the header side walls for positioning the cover on the header to close the cavity. Projection means are provided on the lid, depending therefrom, for closing the polarizing slot in the side walls. Therefore, after soldering, the cover is removed to open the cavity and, at the same time, to open the polarizing slot. No further steps or procedures are required and the assembly is complete for mating the header with a complementary connector.

A feature of the invention is to provide a pair of the projection means depending from opposite sides of the lid of the cover to close the polarizing slot regardless of the orientation of the cover.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the following description taken in conjunction with the accompanying drawings, in which like reference numerals identify like elements in the figures and in which:

DETAILED DESCRIPTION OF THE PREFERRED EMBODIMENT

Figure 1:
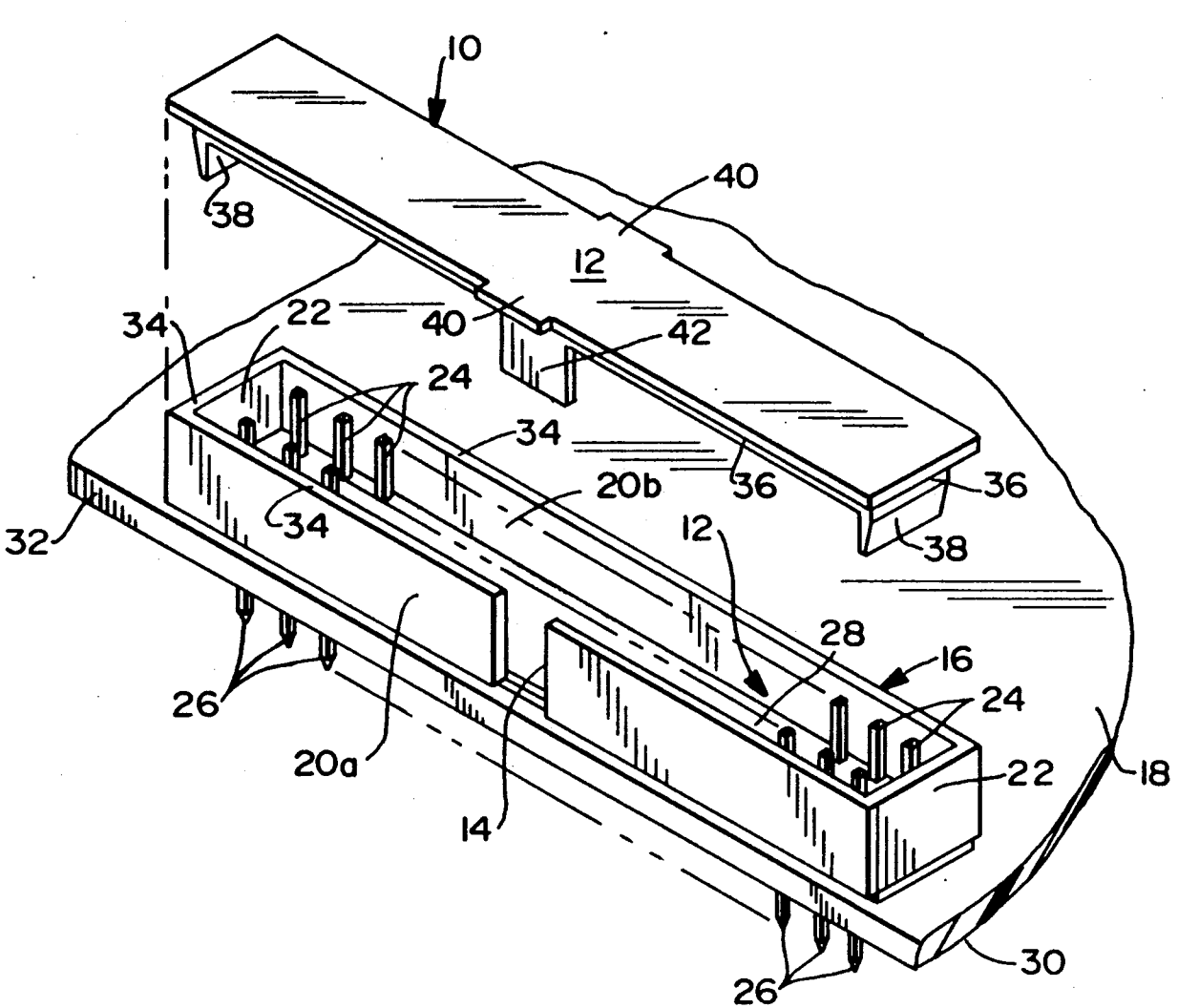
FIG 1 is a perspective view of an electrical connector in the form of a header mounted along an edge of a printed circuit and including a cover incorporating the concepts of this invention.

Referring to the drawings in greater detail, the invention is directed to a cover, generally designated 10, for closing a cavity, generally designated 12 (FIG. 1), and a polarizing slot 14 of an electrical connector in the form of a header, generally designated 16, during a soldering process when the header is mounted on a printed circuit board 18.

As shown in FIG. 1, header 16 is of a conventional configuration in that it is generally rectangular, elongated and includes side wall means defining cavity 12. The side wall means include opposite side walls **20*a* and 20*b* and end walls 22. A plurality of terminal pins 24 are disposed in cavity 12, with solder tails 26 projecting through a bottom wall 28 of the header. When the header is mounted on printed circuit board 18, solder tails 26 project through appropriate holes (not shown) in the board for soldering to circuit traces on a bottom side 30** of the board. Conventionally, the soldering is done by a wave soldering process.

It can be seen in FIG. 1 that header 16 is mounted along an edge 32 of printed circuit board 18, and that polarizing slot 14 in side wall **20*a* is open along that edge. Such edge mounting is quite common to make efficient use of an entire printed circuit board, and the disposition of the polarizing slot at an edge often is unavoidable because of the arrangement of the circuitry of the board. As stated above, such an arrangement causes problems because of the susceptibility of the soldering material entering the polarizing slot and contaminating the interior of the header, particularly the susceptibility of the soldering material contacting terminal pins 24**.

Heretofore, the predominant solution of protecting the interior of header 16 has been to close cavity 12 with a temporary cover and to close polarizing slot 14 with a scored portion of side wall 20*a* which is punched out after the soldering process.

Figure 2:
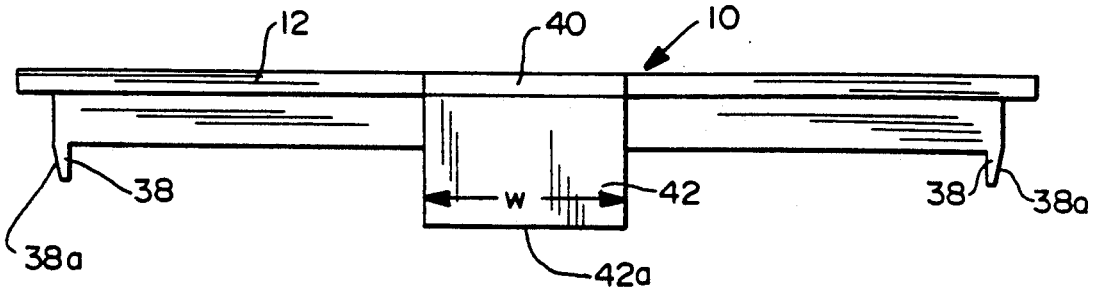
FIG. 2 is a side elevational view of the cover.
Figure 3:
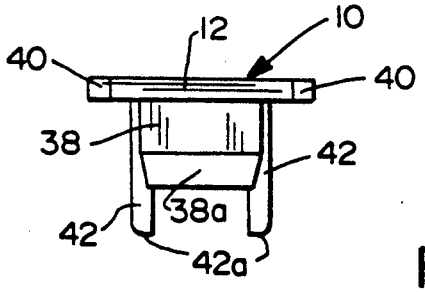
FIG. 3 is an end elevational view of the cover.
Figure 4:
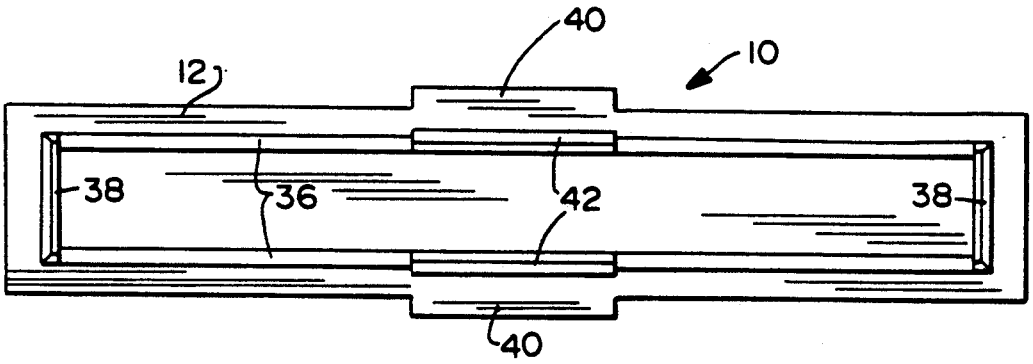
FIG. 4 is a bottom plan view of the cover.

Referring to FIGS. 2–4 in conjunction with FIG. 1, cover 10 includes a generally planar lid 12 which is rectangularly shaped complementary to the shape of header 16 and is sized larger than cavity 12 to overly and seat upon an upper edge 34 of side wall means 20*a*, 20*b*, 22 completely surrounding cavity 12. A rectangular flange 36 depends from lid 12 and is of a size and shape to press fit into cavity 12 immediately below upper edge 34.

In order to facilitate positioning cover 10 onto header 16 to close cavity 12, a pair of end tabs 38 are provided for positioning within end walls 22 of the header. It can be seen in FIG. 2 that the tabs are chamford, as at 38*a*, to guide the cover into position to close the cavity.

In order to facilitate removal of cover 10 after a soldering process, outwardly projecting tabs 40 are provided intermediate the ends of lid 12 for grasping by one's fingers to lift the cover off of the header.

The invention contemplates at least one projection 42 depending from lid 12 for closing polarizing slot 14 in side wall 20*a* to prevent any soldering material from entering the header cavity through the slot. In the illustrated embodiment, projection 42 actually depends from the bottom edge of flange 36 as a continuation thereof. The entire cover is integrally molded of plastic material.

When cover 10 is properly positioned on header 16 to close cavity 12 and polarizing slot 14, a bottom edge 42*a* (FIG. 2) of projection 42 seats onto the top of bottom wall 28 of the header to insure that no soldering material seeps into the header cavity. The width "W" (FIG. 2) of projection 42 is wider than polarizing slot 14 so that the projection overlies an area of side wall 20*a* inside cavity 12, again to provide a good barrier against migration of soldering material into the cavity.

It can be seen in FIGS. 3 and 4 that cover 10 actually is provided with two projections 42 on opposite sides of cover 10. The pair of projections are provided to close the polarizing slot regardless of the orientation of the cover. In other words, such connectors are miniaturized and by providing a pair of projections, an individual who is assembling the printed circuit board does not have to manually manipulate and switch-around the cover during assembly to insure that the polarizing slot is closed. Providing two projections also is an insurance measure so that it is impossible to position the cover on the header without closing the polarizing slot.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. For use with an electrical connector in the form of a header for mounting on a printed circuit board, the header having a cavity with an open top defined by side wall means and a bottom wall, terminals disposed in the cavity with solder tails projecting through the bottom wall for soldering to circuit traces on the printed circuit board, and a polarizing slot in the side wall means, a cover for closing said cavity and said polarizing slot to protect the terminals during a soldering process, the cover comprising lid means including a top wall overlying top edges of the open top, complementary interengaging means between the lid means and the side wall means of the header for positioning the cover on the header to close the cavity, and projection means depending from the lid means in position for closing the polarizing slot in the side wall means.

2. The cover of claim 1 wherein the header is elongated with the polarizing slot on one side thereof, the cover is complementarily elongated, and including projection means on opposite sides of the cover to close the polarizing slot regardless of the longitudinal direction of orienting the cover relative to the header.

3. The cover of claim 1 wherein said projection means is wider than the polarizing slot to overly areas of the side wall means about the slot.

4. The cover of claim 1 wherein said complementary interengaging means comprise flange means depending from the top wall for establishing a press fit with the side wall means.

5. The cover of claim 4 wherein said projection means comprise an extension of the flange means at a position to close the polarizing slot.

6. The cover of claim 5 wherein said projection means is wider than the polarizing slot to overly areas of the side wall means about the slot.

7. A system for protecting terminal pins in a cavity of an electrical connector during a soldering process, wherein the electrical connector is in the form of an elongated header for mounting on a printed circuit board, the header having a cavity with an open top defined by side wall means and a bottom wall, terminals disposed in the cavity with solder tails projecting through the bottom wall for soldering to circuit traces on the printed circuit board, and a polarizing slot in the side wall means on one elongated side of the header, a cover for closing said cavity and said polarizing slot to protect the terminals during the soldering process, the cover comprising lid means including a top wall overlying top edges of said open top, flange means depending from the top wall for positioning the cover on the header to close the cavity and establish a press-fit with the side wall means, and projection means depending from each opposite side of the lid means in position for closing the polarizing slot in the wall means regardless of the longitudinal direction of orienting the cover relative to the header.

8. The system of claim 7 wherein each said projection means comprise an extension of the flange means at positions to close the polarizing slot.

9. The system of claim 8 wherein each said projection means is wider than the polarizing slot to overly areas of the side wall means about the slot.

10. For use with an electrical connector in the form of a header for mounting on a printed circuit board, the header having a cavity defined by side wall means and a bottom wall, terminals disposed in the cavity with solder tails projecting through the bottom wall for soldering to circuit traces on the printed circuit board, and a polarizing slot in the side wall means, a cover for closing said cavity and said polarizing slot to protect the terminals during a soldering process, the cover comprising lid means including a top wall overlying top edges of said open top, complementary interengaging means between the lid means and the side wall means for positioning the cover on the header to close the cavity, and projection means depending from the lid means in position for closing the polarizing slot in the side wall means, the projection means being wider than the polarizing slot to overly areas of the side wall means about the slot.

11. In combination with an electrical connector receptacle having an open top for mounting on a printed circuit board, the receptacle including a cavity defined at least in part by a side wall having an open polarizing slot therein, a cover overlying a top edge of the open top for closing the cavity and including a portion of the cover closing the polarizing slot to protect the inside of the receptacle.

12. The combination of claim 11 wherein said receptacle is elongated with the polarizing slot in one elongated side wall thereof, said cover is complementarily elongated, and including a pair of said portions on opposite sides of the cover to close the polarizing slot regardless of the longitudinal orientation of the cover.

13. The combination of claim 11 wherein said portion of the cover is spaced inwardly of an outer edge of the cover to close the inside of the polarizing slot.

14. The combination of claim 13 wherein said portion of the cover is wider than the polarizing slot to overly inside areas of the side wall about the slot.

* * * * *